US007722024B2

(12) United States Patent
Jeong

(10) Patent No.: US 7,722,024 B2
(45) Date of Patent: May 25, 2010

(54) APPARATUS AND METHOD FOR DETECTING POSITIONS OF STACK GUIDE AND STACK ROLLER

(75) Inventor: Yun Seok Jeong, Gyunggi-Do (KR)

(73) Assignee: Nautilus Hyosung Inc., Seoul (KR)

( * ) Notice: Subject to any disclaimer, the term of this patent is extended or adjusted under 35 U.S.C. 154(b) by 257 days.

(21) Appl. No.: 11/765,477

(22) Filed: Jun. 20, 2007

(65) Prior Publication Data

US 2008/0006564 A1 Jan. 10, 2008

(30) Foreign Application Priority Data

Jun. 22, 2006 (KR) ..... 10-2006-0056560

(51) Int. Cl.
*B65H 5/22* (2006.01)
*B65H 83/00* (2006.01)
*B65H 85/00* (2006.01)

(52) U.S. Cl. ..... 271/3.08; 271/3.01; 271/3.12

(58) Field of Classification Search ..... 271/3.01, 271/3.02, 3.03, 3.08, 3.12, 163
See application file for complete search history.

(56) References Cited

U.S. PATENT DOCUMENTS 4,718,655 A * 1/1988 Okayama et al. ..... 271/3.08
5,553,840 A * 9/1996 Arikawa ..... 271/3.08
6,357,598 B1 * 3/2002 Kimura et al. ..... 209/534
6,533,261 B2 * 3/2003 Katou et al. ..... 271/3.12
6,942,207 B2 * 9/2005 Katou et al. ..... 271/3.01
7,380,784 B2 * 6/2008 Mizuno ..... 271/207
2004/0135304 A1 * 7/2004 Tokunaga et al. ..... 271/3.01
2006/0012101 A1 * 1/2006 Katou et al. ..... 271/3.12
2009/0236788 A1 * 9/2009 Mizuno ..... 271/3.02

* cited by examiner

*Primary Examiner*—Patrick H Mackey
*Assistant Examiner*—Patrick Cicchino
(74) *Attorney, Agent, or Firm*—Fish & Richardson P.C.

(57) ABSTRACT

An object of the present invention is to stably perform money deposit and withdrawal operations in a recyclebox by detecting positions of a stack guide and a stack roller.

An apparatus for detecting the positions of a stack guide and a stack roller includes a stack roller positioned below a feed roller to come in contact with the outer periphery of the feed roller so that a plurality of wings thereof pushes the end of paper money to be deposited when money is deposited in order to align and stack the paper money, and the wings recede from a conveyance path of paper money when money is withdrawn; a stack guide fixed to a rotating shaft of the feed roller; and a position detecting unit detecting positions of the stack roller and the stack guide when money is deposited/withdrawn.

4 Claims, 10 Drawing Sheets

APPARATUS AND METHOD FOR DETECTING POSITIONS OF STACK GUIDE AND STACK ROLLER

BACKGROUND OF THE INVENTION

1. Field of the Invention

The present invention relates to an apparatus and method for detecting positions of a stack roller and a stack guide, and more particularly, to an apparatus and method for detecting positions of a stack roller and a stack guide that are positioned on a conveyance path of paper money to perform a paper money deposit operation in a recyclebox where paper money is deposited and withdrawn.

2. Description of the Related Art

A recyclebox is a circulatory box that is provided in an automatic teller machine and stores paper money to be withdrawn and deposited. The recyclebox is provided in an automatic teller machine where paper money can be deposited and withdrawn, among automatic teller machines.

For example, a recyclebox includes a push plate, a plurality of money withdrawing rollers, and a plurality of money depositing rollers. The push plate ascends and descends, and paper money is stacked on the push plate. The plurality of money withdrawing rollers is provided above the push plate and withdraws the paper money stacked on the push plate. The plurality of money depositing rollers conveys and stacks paper money, which is to be deposited, into the upper portion of the recyclebox.

The recyclebox further includes a stack guide and a stack roller, so that a stable money deposit operation is performed. The stack guide allows the paper money, which is to be deposited during a money deposit operation, not to come in contact with the money withdrawing rollers. Further, the stack guide is swung downward to guide paper money, which is to be deposited, along a conveyance path of paper money. Wings of the stack roller are positioned on the conveyance path of paper money, and push the end of the paper money to be conveyed along the stack guide so that the paper money is aligned and stacked.

Specifically, the push plate descends during a paper money deposit operation in order to secure a money deposit space in the recyclebox. Then, paper money to be deposited is conveyed to the money deposit space by the money depositing rollers, and is stacked on the push plate. Further, the stack guide and the stack roller facilitate the stacking of the paper money, and the push plate ascends during a paper money withdrawal operation so that the paper money stacked on the push plate comes in contact with and presses the money withdrawing rollers. Accordingly, the stacked paper money is separated and withdrawn one-by-one.

Meanwhile, the stack guide is swung upward during the money withdrawal operation so that the push plate comes in contact with and presses the money withdrawing rollers. For this reason, the money withdrawing rollers comes in contact with the paper money stacked on the push plate. As a result, the stacked paper money is separated and withdrawn one-by-one.

Further, the stack roller is also swung downward during the money withdrawal operation so as to recede from the conveyance path of the paper money. Accordingly, the money withdrawal operation is smoothly performed.

In this case, there is required an apparatus for performing a control so that the money deposit and withdrawal operations are smoothly performed by detecting the positions of the stack guide and the stack roller that are swung upward and downward.

SUMMARY OF THE INVENTION

Accordingly, the present invention has been made to solve the above-mentioned problems and it is an object of the present invention to provide an apparatus and method for detecting positions of a stack roller and a stack guide that can stably perform money deposit and withdrawal operations in a recyclebox by detecting the positions of a stack guide and a stack roller.

In order to achieve the above-mentioned object, according to an aspect of the present invention, an apparatus for detecting the positions of a stack guide and a stack roller includes a stack roller positioned below a feed roller to come in contact with the outer periphery of the feed roller so that a plurality of wings thereof pushes the end of the paper money to be deposited when money is deposited in order to align and stack the paper money, and the wings recede from a conveyance path of paper money when money is withdrawn; a stack guide fixed to a rotating shaft of the feed roller; and a position detecting unit detecting positions of the stack roller and the stack guide when the money is deposited/withdrawn. The stack guide is swung downward to guide the paper money to be deposited when money is deposited and is swung upward when money is withdrawn so that a pickup roller comes in contact with the paper money.

In the above-mentioned apparatus, the position detecting unit may include a withdrawal detecting sensor that detects the positions of the stack guide and the stack roller when money is withdrawn, a depositing detecting sensor that detects the positions of the stack guide and the stack roller when money is deposited, and a detection plate that is positioned between a light emitting part and a light receiving part of the withdrawal detecting sensor or the depositing detecting sensor.

In this case, the apparatus may further include a stack roller pivot provided to be spaced apart from the stack roller, a rod horizontally provided on a rear side of the stack guide so as to swing the stack guide, a gear that includes a guide protrusion formed on one surface thereof and is rotated by a rotational driving force transmitted from a driving motor, and a slide bar that is fixed to the stack roller pivot at one end thereof and has a slide slot formed at the other end thereof in a longitudinal direction. The guide protrusion is inserted into the slide slot. Accordingly, as the gear is rotated, the slide bar is slidably swung to swing the rod. The detection plate may be interlocked with a driving motor so as to correspond to when a driving motor is driven.

Further, in the above-mentioned apparatus, the position detecting unit may include a shaft having one end fitted to a fixing groove formed in the gear, the other end of the shaft may be fixed to the detection plate, and each of the both ends of the shaft may have a D-shaped cross section.

In addition, according to another aspect of the present invention, a method of detecting positions of a stack guide and a stack roller includes receiving a paper money deposit signal, which is input by a client, using a control unit; sending a driving signal to a driving motor, which changes positions of a stack guide and a stack roller, from the control unit that has received the signal; sending a signal indicating that the stack guide and the stack roller are positioned at money depositing positions to the control unit from a depositing detecting sensor, when the stack guide and the stack roller are positioned at the money depositing positions by the driving motor; and controlling a deposit/withdrawal unit so that paper money is deposited in a recyclebox, when the control unit receives the signal indicating that the stack guide and the stack roller are positioned at the money depositing positions.

Further, according to another aspect of the present invention, a method of detecting positions of a stack guide and a stack roller includes receiving a paper money withdrawal signal, which is input by a client, using a control unit; sending a driving signal to a driving motor, which changes positions of a stack guide and a stack roller, from the control unit that has received the signal; sending a signal indicating that the stack guide and the stack roller are positioned at money withdrawal positions to the control unit from a withdrawal detecting sensor, when the stack guide and the stack roller are positioned at the money withdrawal positions by the driving motor; and controlling a deposit/withdrawal unit so that paper money is deposited in a recyclebox, when the control unit receives the signal indicating that the stack guide and the stack roller are positioned at the money withdrawal positions.

DESCRIPTION OF THE PREFERRED EMBODIMENTS

The structure and operation of an apparatus according to a preferred embodiment of the present invention will be described with reference to accompanying drawings.

Figure 1:
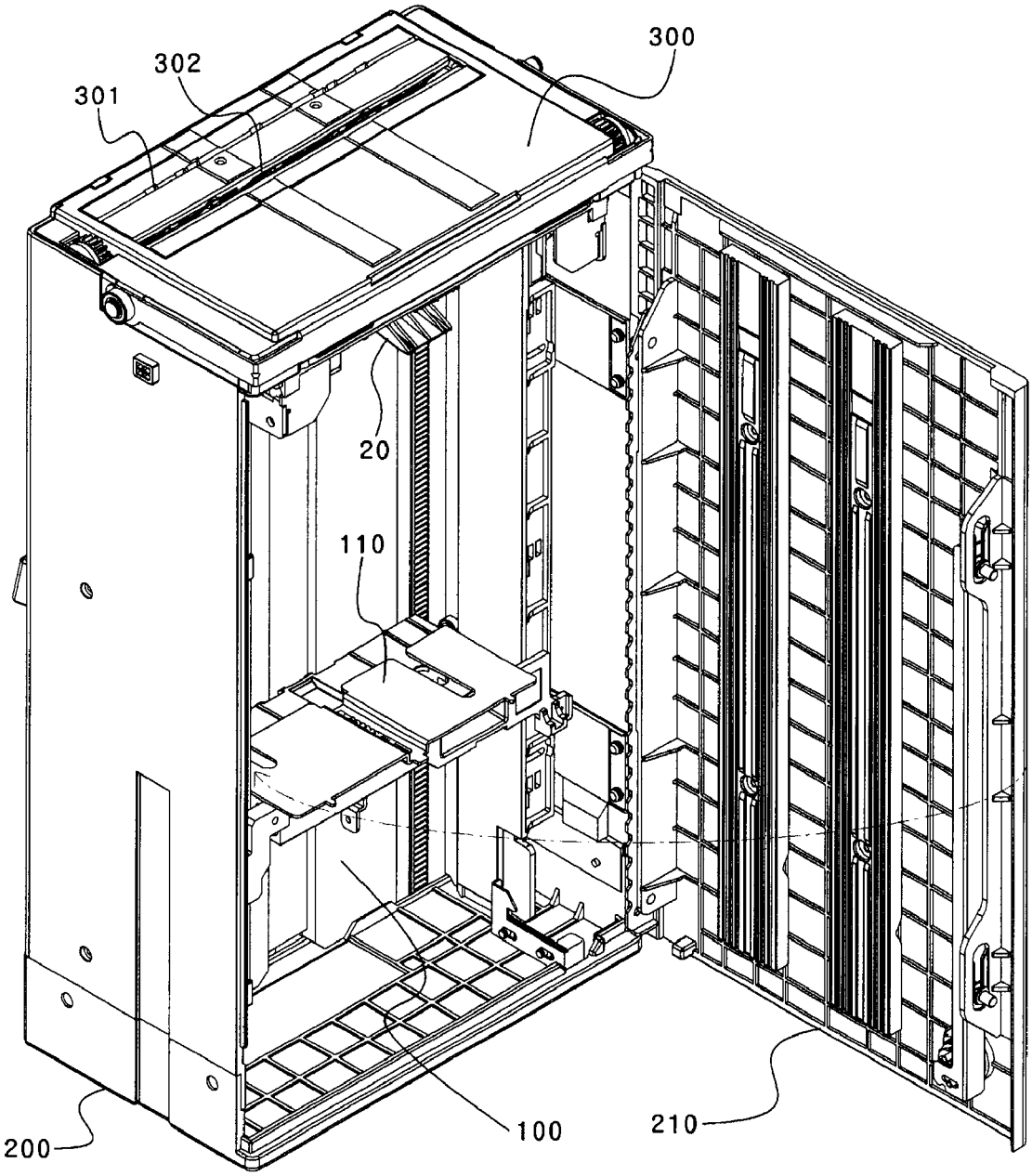
FIG. 1 is a perspective view of a recyclebox that is provided with an apparatus for detecting positions of a stack guide and a stack roller according to an embodiment of the present invention.
Figure 2A:
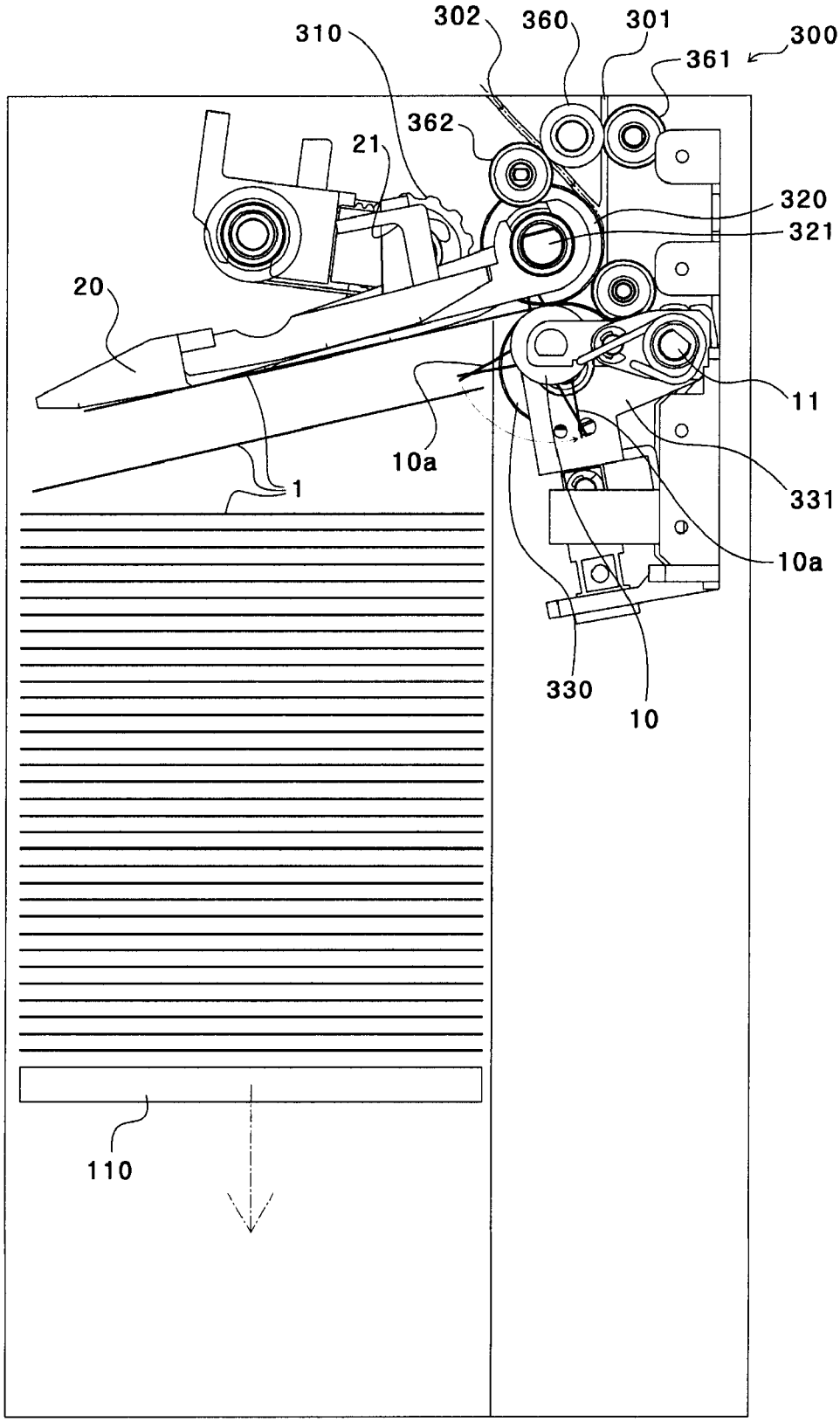
FIG. 2A is a view schematically illustrating a money deposit operation of the recyclebox where the stack guide and the stack roller according to the embodiment of the present invention recede from a conveyance path of paper money.
Figure 2B:
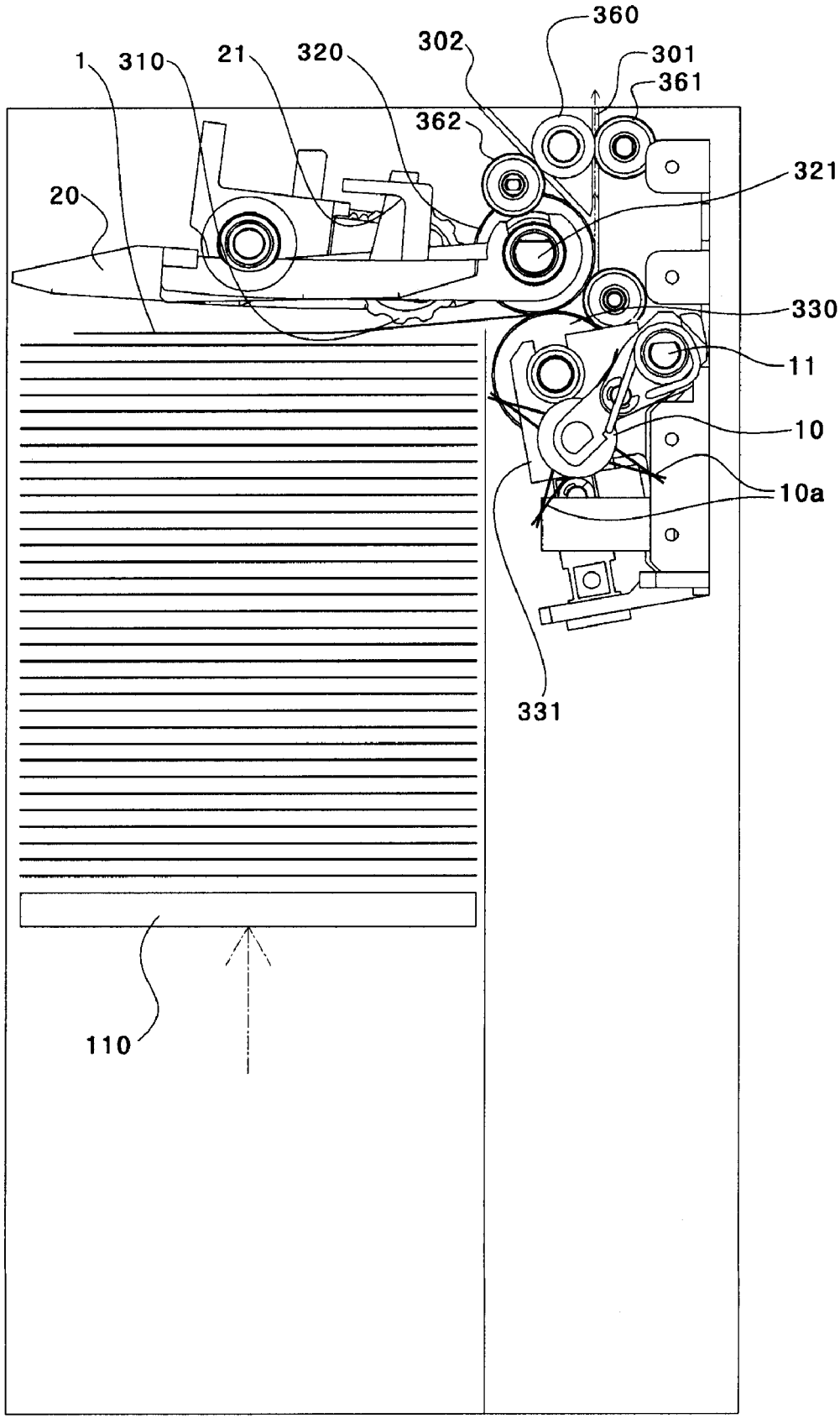
FIG. 2B is a view schematically illustrating a money withdrawal operation of the recyclebox where the stack guide and the stack roller according to the embodiment of the present invention recede from a conveyance path of paper money.

FIG. 1 is a perspective view of a recyclebox that is provided with an apparatus for detecting positions of a stack guide and a stack roller according to an embodiment of the present invention. FIG. 2A is a view schematically illustrating a money deposit operation of the recyclebox where the stack guide and the stack roller according to the embodiment of the present invention recede from a conveyance path of paper money. FIG. 2B is a view schematically illustrating a money withdrawal operation of the recyclebox where the stack guide and the stack roller according to the embodiment of the present invention recede from a conveyance path of paper money.

A recyclebox, which is provided with an apparatus for detecting the positions of a stack guide and a stack roller according to an embodiment of the present invention, includes a stack unit 100, a housing 200, and a deposit/withdrawal unit 300. The stack unit 100 is provided with a push plate 110 that ascends and descends. Paper money 1 is stacked on the push plate. The housing 200 for the recyclebox surrounds the stack unit 100 and is opened/closed by a door 210. The deposit/withdrawal unit 300 is provided on the upper portion of the stack unit 100.

The deposit/withdrawal unit 300 includes a withdrawal port 301, a deposit port 302, a pickup roller 310, a feed roller 320, and a guide roller 330. Paper money 1 to be withdrawn is withdrawn from the box through the withdrawal port 301. Paper money 1 to be deposited enters the box through the deposit port 302. The pickup roller 310 separates paper money 1 stacked on the push plate 110 one-by-one. The feed roller 320 conveys paper money 1 that is separated one-by-one by the pickup roller 310, or conveys paper money 1 that enters the box through the deposit port 302 onto the push plate 110. The guide roller 330 is rotatably supported by a guide roller bracket 331 provided below the feed roller 320, and the outer periphery of the guide roller comes in contact with the feed roller 320.

Further, it is preferable that the deposit/withdrawal unit 300 further include a conveying roller 360, a withdrawal unit pinch roller 361, and a deposit unit pinch roller 362. The conveying roller 360 facilitates to smoothly deposit and withdraw paper money 1 during the money deposit and withdrawal operations. The withdrawal unit pinch roller 361 is provided on one side of the conveying roller 360 facing the withdrawal port 301, and comes in contact with the outer periphery of the conveying roller 360 to press the paper money 1 to be withdrawn against the conveying roller 360. The deposit unit pinch roller 362 is provided on the other side of the conveying roller 360 facing the deposit port 302, and comes in contact with the outer periphery of the conveying roller 360 to press the paper money 1 to be deposited against the conveying roller 360.

According to the above-mentioned structure, paper money 1 can be deposited into or withdrawn from the recyclebox by the normal and reverse rotation of the feed roller 320 and the conveying roller 360.

The money deposit operation of the recyclebox will be described with reference to FIG. 2A. The paper money 1, which is to enter an automatic teller machine through the deposit port 302 along a main conveyance path (not shown) of the automatic teller machine, enters the recyclebox by the counterclockwise rotation of the conveying roller 360. Then, the paper money 1 passes between the feed roller 320 that is rotated in a clockwise direction and the guide roller 330 that comes in contact with the outer periphery of the feed roller 320 and is rotated together with the feed roller, and is stacked on the push plate 110.

In this case, the push plate 110 descends so that a money deposit space is secured in the recyclebox. Further, a stack guide 20 is swung downward and positioned on a conveyance path of paper money 1. Accordingly, the stack guide guides paper money 1 to be deposited, and the pickup roller 310 does not interfere with the paper money 1 that is moving along the conveyance path of paper money 1. In addition, a stack roller 10 should be positioned on the conveyance path of paper money 1 so that wings 10*a* of the stack roller push the end of the paper money 1 to be conveyed, causing the paper money 1 to be aligned and stacked.

Further, the money withdrawal operation of the recyclebox will be described with reference to FIG. 2B. Paper money 1 stacked on the push plate 110 comes in contact with and presses the pickup roller 310. Accordingly, as the pickup roller 310 is periodically rotated in a counterclockwise direction, the paper money 1 is separated one-by-one. After that, the paper money 1 passes between the feed roller 320 that is rotated in the counterclockwise direction and the guide roller 330, passes by the conveying roller 360 that is rotated in the counterclockwise direction, and is then withdrawn through the withdrawal port 301 to the main conveyance path (not shown) of the automatic teller machine.

In this case, the stack guide 20 is swung upward, and the push plate 110 ascends so that the paper money 1 comes in contact with and presses the pickup roller 310. Further, the wings 10*a* of the stack roller 10 should recede from the conveyance path of paper money 1.

Figure 3:
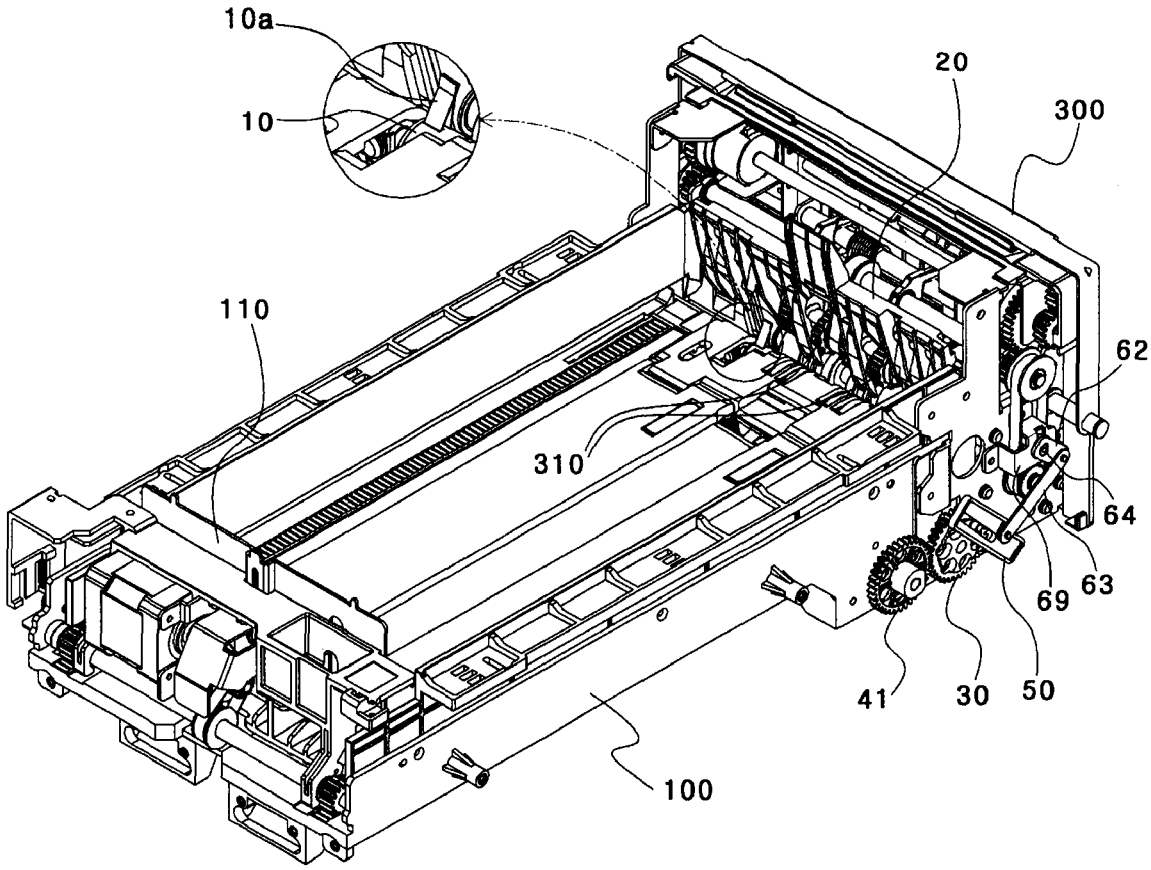
FIG. 3 is a perspective view showing that a housing is removed from the recyclebox shown in FIG. 1.
Figure 4:
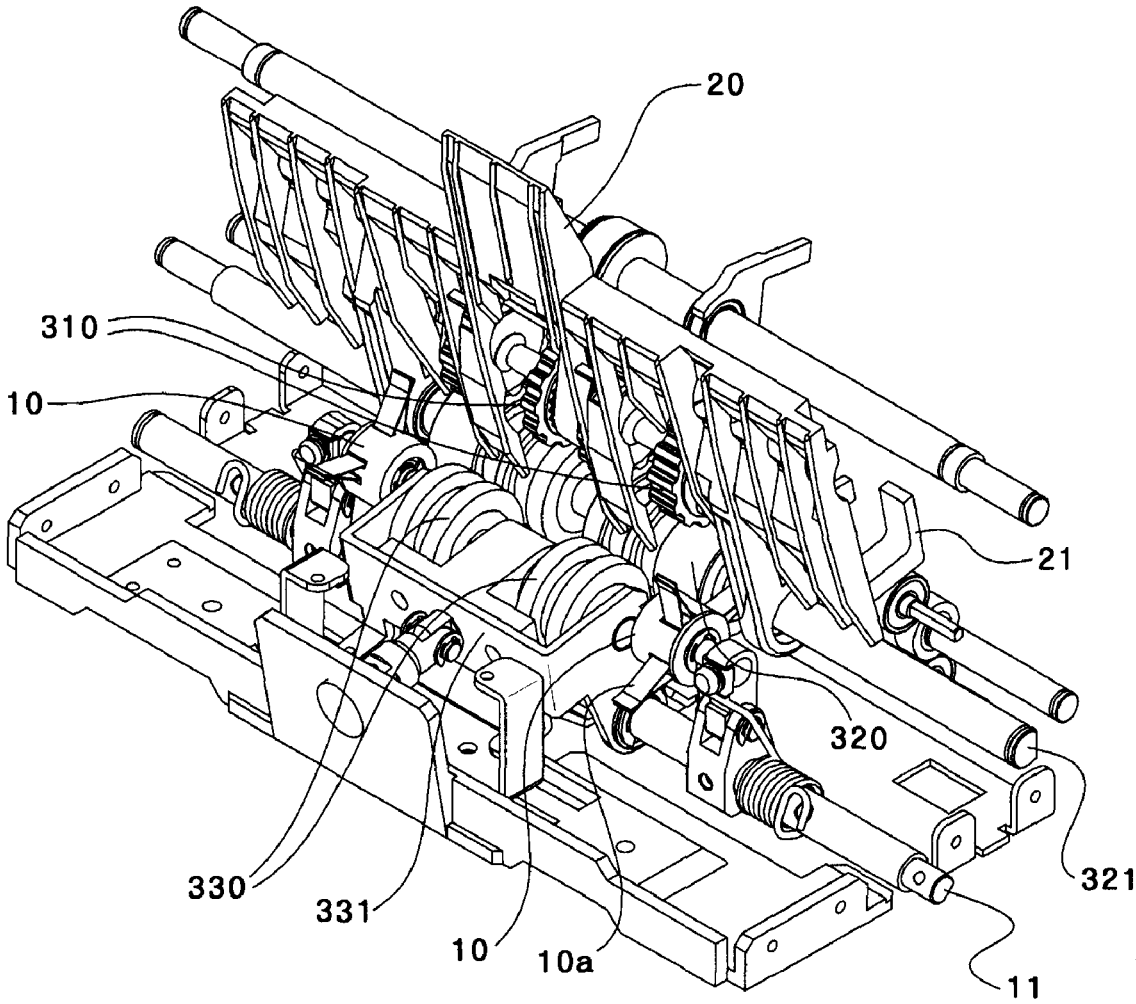
FIG. 4 is a perspective view of components of a deposit/withdrawal unit of the recyclebox shown in FIG. 3.
Figure 5:
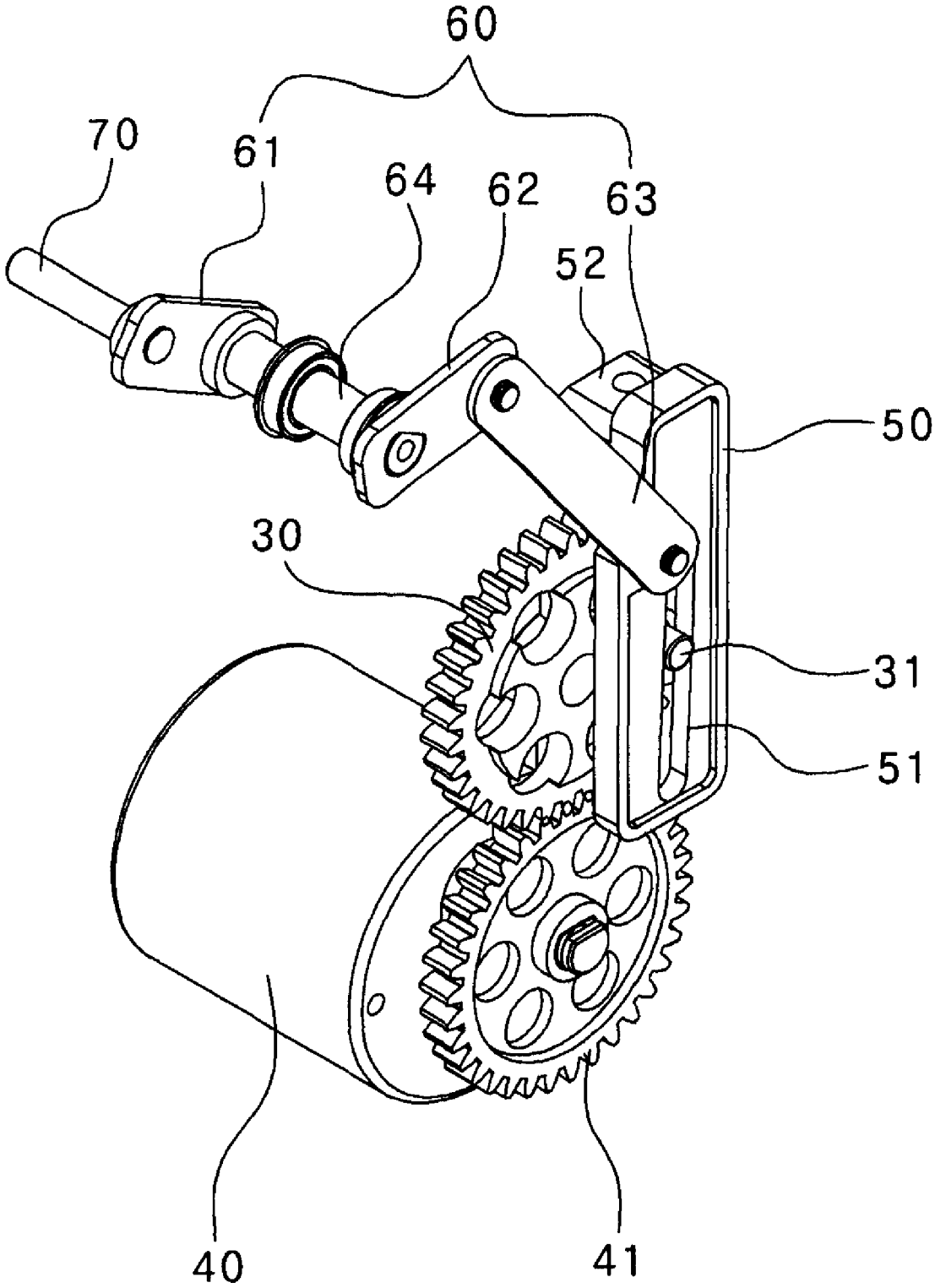
FIG. 5 is a perspective view of components used to allow the stack guide and stack roller to recede in the recyclebox that is provided with the apparatus for detecting the positions of the stack guide and the stack roller according to the embodiment of the present invention.
Figure 6A:
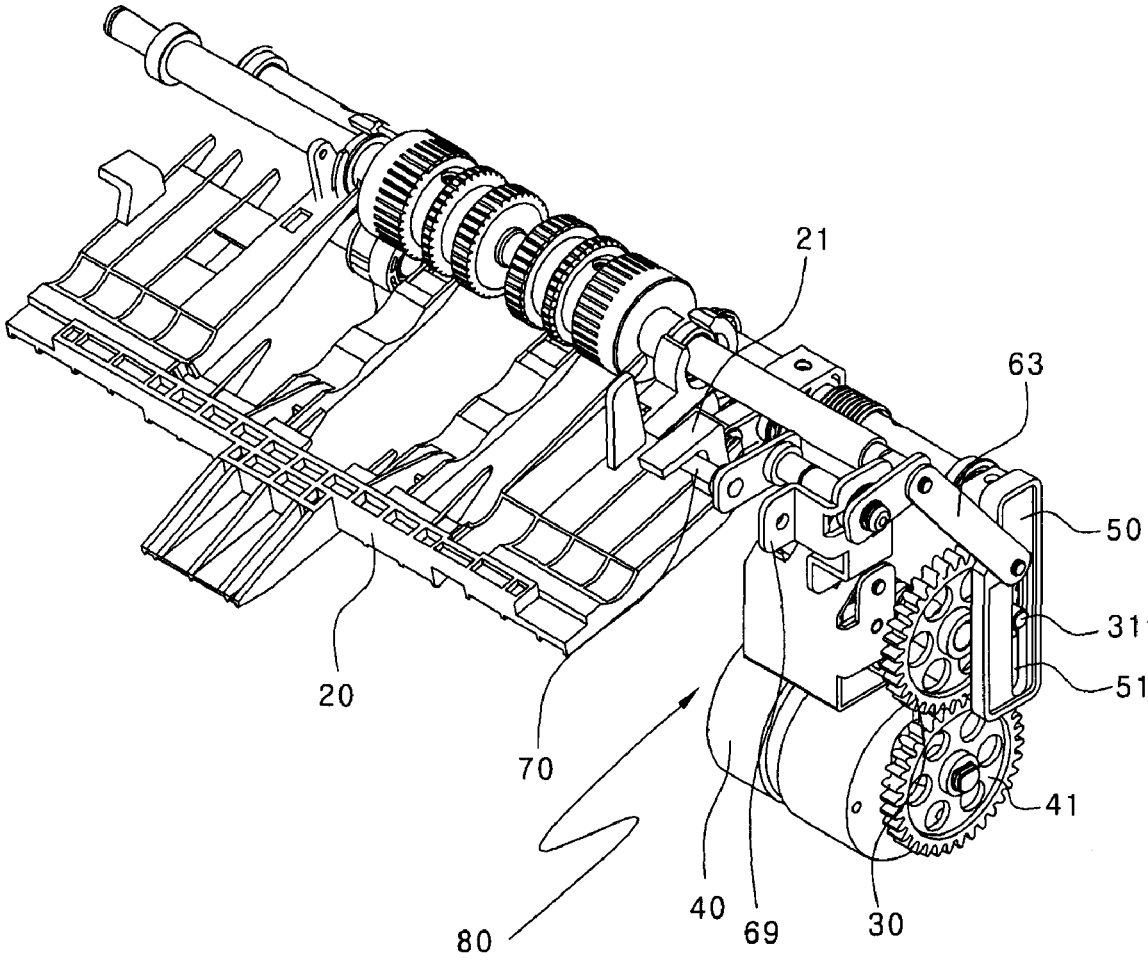
FIGS. 6A and 6B are perspective views of the apparatus for detecting the positions of the stack guide and the stack roller according to the embodiment of the present invention.
Figure 6B:
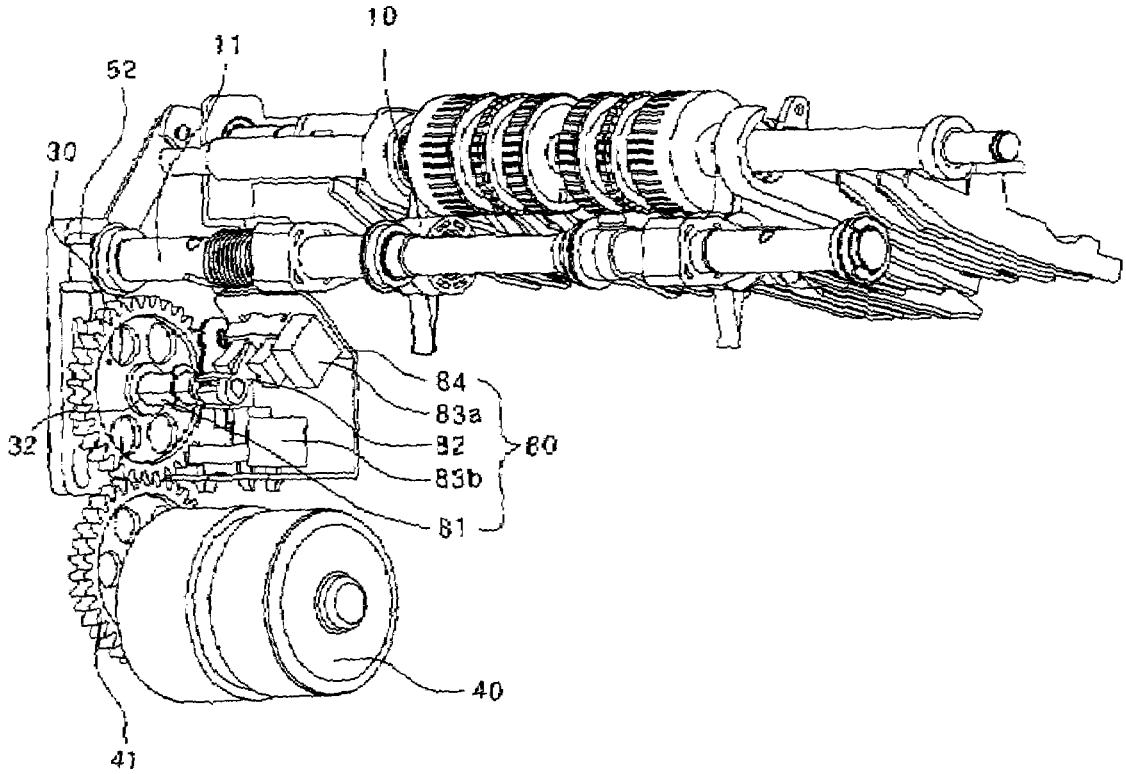

FIG. 3 is a perspective view showing that a housing is removed from the recyclebox shown in FIG. 1, and FIG. 4 is a perspective view of the components of the deposit/withdrawal unit of the recyclebox shown in FIG. 3. FIG. 5 is a perspective view of the components used to allow the stack guide and stack roller to recede in the recyclebox that is provided with the apparatus for detecting the positions of the stack guide and the stack roller according to the embodiment of the present invention. FIGS. 6A and 6B are perspective views of the apparatus for detecting the positions of the stack guide and the stack roller according to the embodiment of the present invention.

According to the embodiment of the present invention, the stack guide 20 and the stack roller 10 facilitating the money deposit and withdrawal operations, which are performed in the recyclebox, are positioned on the conveyance path of paper money 1 during the money deposit operation. However, since the stack guide 20 and the stack roller 10 recede from the conveyance path of paper money 1 during the money withdrawal operation, it is possible to stably perform the money deposit and withdrawal operations.

Referring to FIGS. 2A and 2B, the stack roller 10 is provided to be spaced apart from a center axis of a stack roller pivot 11 that passes through the guide roller bracket 331, and the outer periphery of the stack roller 10 comes in contact with the outer periphery of the feed roller 320. Accordingly, when the feed roller 320 is rotated to deposit paper money 1, the stack roller is also rotated.

The stack guide 20 is fixed to a feed roller rotating shaft 321. A rod 70 horizontally provided on the rear side of the stack guide is swung, so that the stack guide 20 is swung downward during the money deposit operation and is swung upward when money is withdrawn.

For example, a stack guide hook 21 that is bent to have an L shape is provided on the rear surface of the stack guide 20, and the rod 70 is horizontally provided on the stack guide hook 21. As the rod 70 is swung, the stack guide 20 is also swung. The rod 70 is swung due to the rotation of a first link bar pivot 64 to be described below. The first link bar pivot 64 is rotatably supported by a rod supporting bracket 69, which is formed on one side of the deposit/withdrawal unit 300.

Meanwhile, a gear 30 is provided on one surface of the stack unit 100. The gear 30 includes a guide protrusion 31 formed on one surface thereof, and is rotated in a normal or reverse direction by a rotational driving force transmitted from a driving motor 40.

Although not shown, it is preferable that the driving motor 40 be provided at the back of the stack unit 100. It is more preferable that the driving motor 40 be used only to rotate the gear 30 in a normal or reverse direction. Further, the driving motor 40 may be directly connected to the gear 30, or may be connected to the gear 30 via a driving gear 41 as shown in the drawings so as to be able to decelerate due to the change of a gear ratio between the driving gear 41 and the gear 30.

In addition, the stack unit is provided with a slide bar 50. One end of the slide bar 50 is fixed to the stack roller pivot 11, and a slide slot 51 is formed at the other end of the slide bar 50 in a longitudinal direction of the slide bar. The guide protrusion 31 of the gear 30 is inserted into the slide slot 51 of the slide bar 50. Accordingly, as the gear 30 is rotated, the slide bar 50 is swung.

Meanwhile, a coupling protrusion 52 protrudes from one end of the slide bar 50 as shown in FIG. 5, and has a groove (not shown). One end of the stack roller pivot 11, which is cut to have a D-shaped cross section as shown in FIG. 4, is inserted into the groove.

Further, the rod 70 is horizontally provided at the rear side of the stack guide 20 as described above, so as to be used to swing the stack guide 20.

A link connection unit 60 is provided so that the stack roller 10 and the stack guide 20 are positioned on or recede from the conveyance path of paper money 1 depending on the normal or reverse rotation of the gear 30. The link connection unit 60 includes a plurality of link bars 61, 62, and 63 between the slide bar 50 and the rod 70.

The link connection unit 60 includes a first link bar 61, a first link bar pivot 64, a second link bar 62, and a third link bar 63. The rod 70 is fixed to one end of the first link bar 61. The first link bar pivot 64 is fixed to the other end of the first link bar 61, and is rotated in a normal or reverse direction so as to swing the first link bar 61. The first link bar pivot 64 is fixed to one end of the second link bar 62. One end of the third link bar 63 is connected to the other end of the second link bar 62 by a hinge, and the other end of the third link bar 63 is connected to one side of the slide bar 50 by a hinge.

Referring to FIG. 6, a position detecting unit 80 is provided near the gear 30 so as to detect the positions of the stack roller 10 and the stack guide 20 when money is deposited and withdrawn. The position detecting unit 80 includes a detection plate 82, a withdrawal detecting sensor 83*a*, and a depositing detecting sensor 83*b*. The detection plate 82 is interlocked with the driving motor 40 so as to correspond to when a driving motor is driven. The withdrawal detecting sensor 83*a* and the depositing detecting sensor 83*b* detect the position of the detection plate 82 to detect the positions of the stack roller 10 and the stack guide 20 when money is deposited and withdrawn.

In this case, the detection plate 82 is connected to the gear 30 by a shaft 81, and is thus interlocked with the driving motor 40 so as to correspond to when the driving motor is driven. For this purpose, a fixing groove 32 is formed in the gear 30. In addition, one end of the shaft 81 is inserted into the fixing groove 32, and the other end of the shaft 81 is fixed to the detection plate 82. Each of the shaft 81 and the fixing groove 32 has a D-shaped cross section and a hole having a D-shaped cross section is formed in the detection plate 82, so as to be fitted to each other.

The withdrawal detecting sensor 83*a* and the depositing detecting sensor 83*b* are fixed to a sensor supporting bracket 84 fixed to the stack unit 100. When the detection plate 82 is positioned between a light emitting part and a light receiving part of each of the withdrawal detecting sensor 83*a* and the depositing detecting sensor 83*b*, the withdrawal detecting sensor 83*a* and the depositing detecting sensor 83*b* determine the money withdrawal position and the money depositing position of each of the stack roller 10 and the stack guide 20. Then, the sensors send signals to a control unit (not shown), and the control unit sends control signals to the deposit/withdrawal unit 300 such that the deposit/withdrawal unit 300 perform money deposit or withdrawal processes.

Figure 7A:
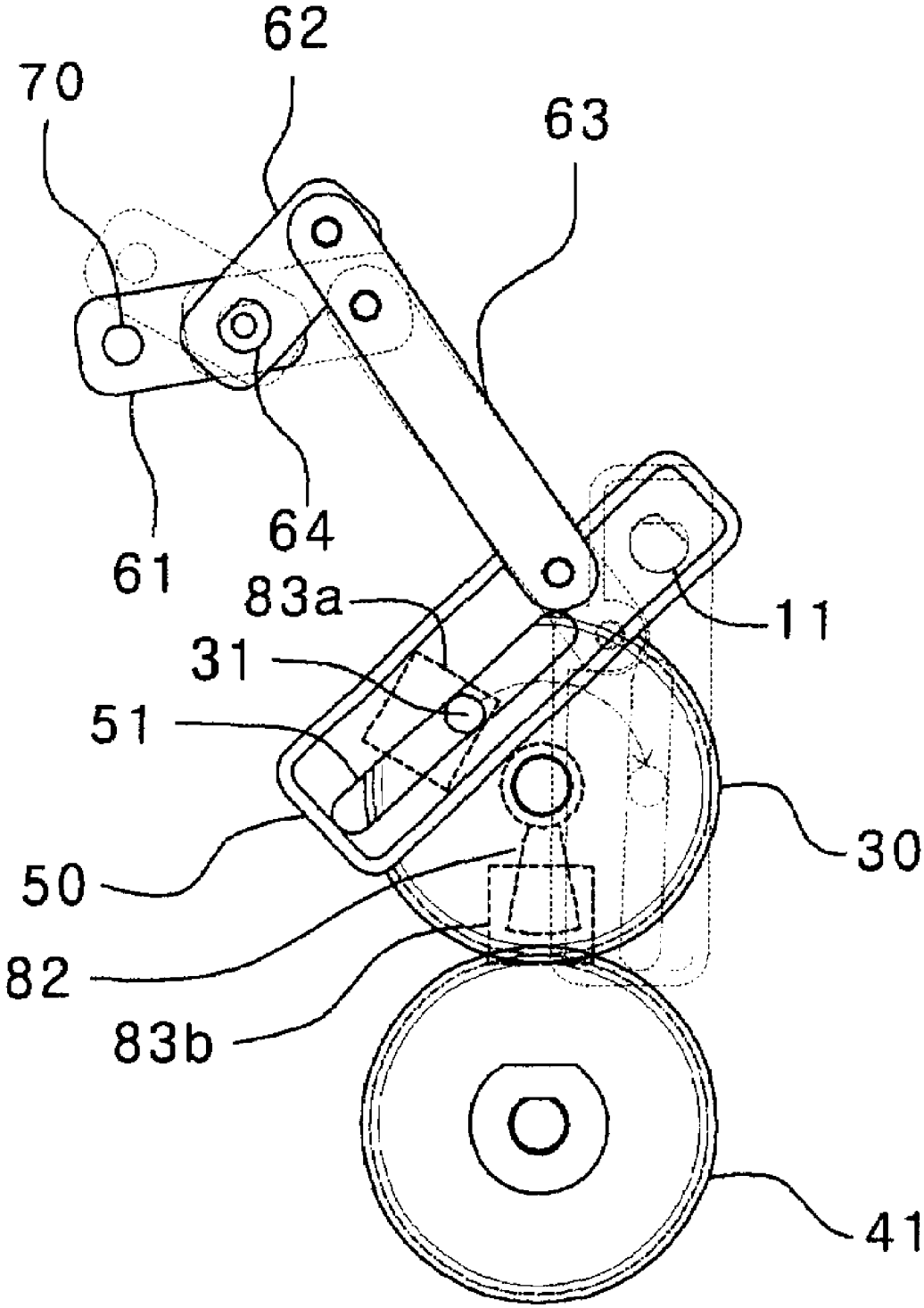
FIGS. 7A and 7B are views illustrating the operation of the recyclebox that is provided with the apparatus for detecting the positions of the stack guide and the stack roller according to the embodiment of the present invention.
Figure 7B:
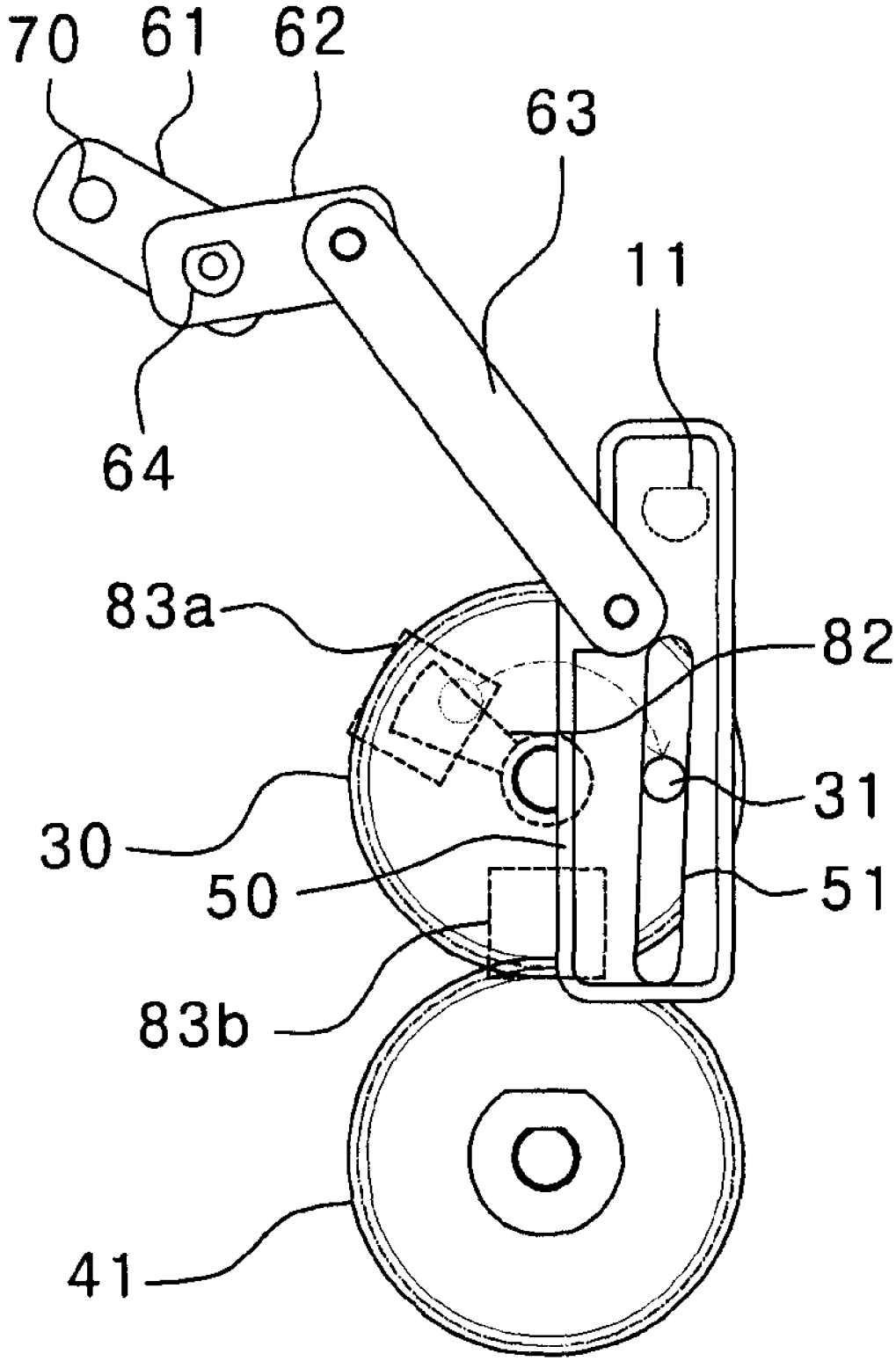

FIG. 7 is a view illustrating the operation of the recyclebox that is provided with the apparatus for detecting the positions of the stack guide and the stack roller according to the embodiment of the present invention. FIG. 7A is a view showing that the gear 30, the slide bar 50, and the link connection unit 60 are connected with each other when the stack guide 20 and the stack roller 10 are positioned on the conveyance path of paper money 1 during the money deposit operation of the recyclebox. FIG. 7B is a view showing that the gear 30, the slide bar 50, and the link connection unit 60 are connected with each other when the stack guide 20 and the stack roller 10 recede from the conveyance path of paper money 1 during the money withdrawal operation of the recyclebox.

Operations, where the stack roller and the stack guide according to the embodiment of the present invention are positioned on and recede from the conveyance path of paper money 1 when money is deposited/withdrawn, will be described with reference to FIGS. 2A to 2B.

FIG. 7A shows the stack guide 20 and the stack roller 10, which correspond to FIG. 2A.

A money depositing process will be described with reference to FIG. 7. First, the control unit receives a paper money 1 depositing signal that is input by a client. The control unit that has received the signal sends a driving signal to the driving motor 40 in order to operate the stack guide 20 and the stack roller 10.

When the driving motor 40 that has received the driving signal is driven, the gear 30 is rotated and the detection plate 82 is positioned between the light emitting part and the light receiving part of the depositing detecting sensor 83*b*. In this case, the control unit that has received the signal from the depositing detecting sensor 83*b* determines that the stack roller 10 and the stack guide 20 are positioned at the money depositing position. Then, a money depositing process where paper money 1 is deposited in the recyclebox is performed.

As described above, according to the embodiment of the present invention, it is possible to set the money depositing positions of the stack roller 10 and the stack guide 20 by driving one driving motor 40. Accordingly, it is possible to detect two interlocked operations (operations of the stack roller and the stack guide) by one depositing detecting sensor 83*b* that detects the detection plate 82 interlocked with the driving motor 40.

FIG. 7B shows the stack guide 20 and the stack roller 10, which correspond to FIG. 2B.

The control unit receives a paper money 1 withdrawing signal that is input by a client. The control unit that has received the signal sends a driving signal to the driving motor 40 in order to operate the stack guide 20 and the stack roller 10.

The stack guide 20 and the stack roller 10 are positioned at a money withdrawal position by the driving motor 40 that has received the driving signal. That is, when the gear 30 is rotated in a clockwise direction from a position of FIG. 7A to a position of FIG. 7B, the stack roller pivot 11 fitted to the coupling protrusion 52 of the slide bar 50 is rotated in a counterclockwise direction. For this reason, the stack roller 10 that is eccentrically fixed to the stack roller pivot 11 is also swung downward to recede from the conveyance path of paper money 1. Further, the first link bar 61, the second link bar 62, the third link bar 63, and the first link bar pivot 64, which are linked to the slide bar 50, also operate relative to each other, so that the rod 70 is swung. As a result, the stack guide 20 also recedes from the conveyance path of paper money 1.

In this case, as the gear 30 is rotated, the detection plate 82 is also rotated and positioned between the light emitting part and the light receiving part of the withdrawal detecting sensor 83*a*. Further, the control unit determines that the stack roller 10 and the stack guide 20 are positioned at the money withdrawal position. Then, a money withdrawing process is performed.

In contrast, when the gear 30 is rotated in a counterclockwise direction from a position of FIG. 7B to a position of FIG. 7A, the stack roller 10 and the stack guide 20 are positioned on the conveyance path of paper money 1 in a reverse order of the above-mentioned order. Further, the detection plate 82 is positioned between the light emitting part and the light receiving part of the depositing detecting sensor 83*b*. Accordingly, the control unit performs the money depositing process.

As described above, according to the embodiment of the present invention, it is possible to smoothly control money deposit/withdrawal operations by detecting the positions of a stack guide and a stack roller in a recyclebox when money is deposited/withdrawn. Further, since the stack guide and the stack roller are controlled by one driving motor, it is advantageous in that controlling an ATM can be simplified.

What is claimed is:

1. An apparatus for detecting positions of a stack guide and a stack roller, the apparatus comprising:

a stack roller positioned below a feed roller to come in contact with an outer periphery of the feed roller so that a plurality of wings thereof pushes the end of paper money to be deposited when money is deposited in order to align and stack the paper money, and the wings recede from a conveyance path of paper money when money is withdrawn;

a stack guide fixed to a rotating shaft of the feed roller, the stack guide being swung downward to guide the paper money to be deposited when money is deposited and being swung upward when money is withdrawn so that a pickup roller comes in contact with the paper money;

a gear rotated by a rotational driving force transmitted from a driving motor;

a detection plate connected to the gear and interlocked with the driving motor so as to correspond to when the driving motor is driven; and detecting sensors detecting the positions of the detection plate when the driving motor is driven, wherein the stack guide and the stack roller are interlocked with the gear so as to correspond to when the gear is driven, wherein the detecting sensors detect the positions of the detection plate so as to detect positions of the stack guide and the stack roller when money is deposited or withdrawn.

2. The apparatus according to claim 1, wherein the detecting sensors include:

a withdrawal detecting sensor detecting the positions of the stack guide and the stack roller when money is withdrawn; and a depositing detecting sensor detecting the positions of the stack guide and the stack roller when money is deposited.

3. The apparatus according to claim 2, further comprising:

a stack roller pivot provided to be spaced apart from the stack roller;

a rod horizontally provided on a rear side of the stack guide so as to swing the stack guide;

a slide bar fixed to the stack roller pivot at one end thereof and having a slide slot formed at the other end thereof in a longitudinal direction;

a guide protrusion integrally formed with the gear and inserted into the slide slot; and a plurality of link bars linked between the rod and the slide bar, wherein the slide bar is slidably swung to swing the rod and the stack roller pivot depending on the rotation of the gear.

4. The apparatus according to claim 2, further comprising:

a shaft having one end fitted to a fixing groove formed in the gear and the other end fitted to the detection plate, and wherein each of the both ends of the shaft has a D-shaped cross section.

* * * * *